343-756 SR
9/5/78 XR 4,112,432

United States Patent [19]
Wong et al.

[11] 4,112,432
[45] Sep. 5, 1978

[54] SQUARE HORN ANTENNA HAVING IMPROVED ELLIPTICITY

[75] Inventors: Mon N. Wong; Timothy A. Crail, both of Culver City, Calif.

[73] Assignee: Hughes Aircraft Company, Culver City, Calif.

[21] Appl. No.: 734,707

[22] Filed: Oct. 21, 1976

[51] Int. Cl.[2] ..... H01Q 13/02; H01P 5/12
[52] U.S. Cl. ..... 343/786; 343/783; 343/756
[58] Field of Search ..... 343/786, 783, 756; 333/21 A

[56] References Cited

U.S. PATENT DOCUMENTS

| | | | |
|---|---|---|---|
| 2,577,619 | 12/1951 | Kock | 343/783 |
| 3,046,550 | 7/1962 | Bartholomä et al. | 343/783 |
| 3,413,642 | 11/1968 | Cook | 343/783 |
| 3,482,251 | 12/1969 | Bowes, Jr. | 343/786 |

*Primary Examiner*—Alfred E. Smith
*Assistant Examiner*—David K. Moore
*Attorney, Agent, or Firm*—Rafael A. Cardenas; W. H. MacAllister

[57] ABSTRACT

A multisided horn antenna such as a square horn is disclosed having an improved axial ratio circular polarization or ellipticity. Ellipticity of a square horn antenna is improved by placing a conical section or ring of conductive material at the aperture of a horn antenna. The conical ring causes a relatively directive beam having a low axial ratio to be produced throughout most of the pattern generated similar to that of a conical horn antenna. Yet, the square horn antenna provides increased power over a conical horn.

4 Claims, 8 Drawing Figures

Fig. 1.
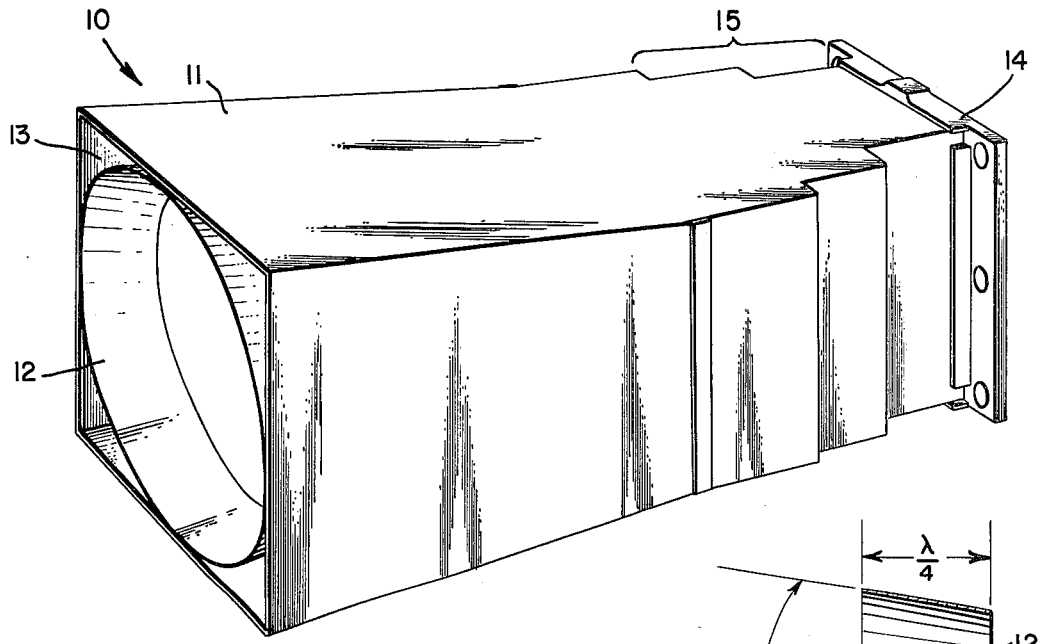
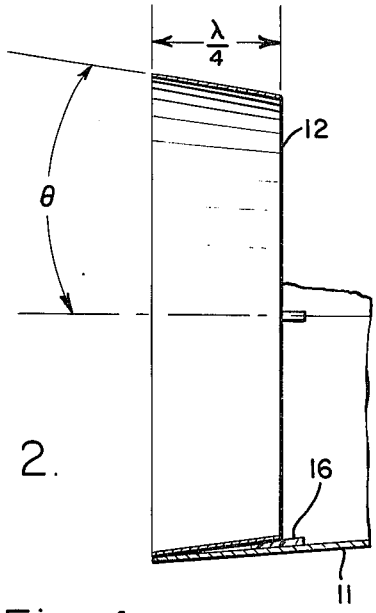
Fig. 2.
Fig. 3.
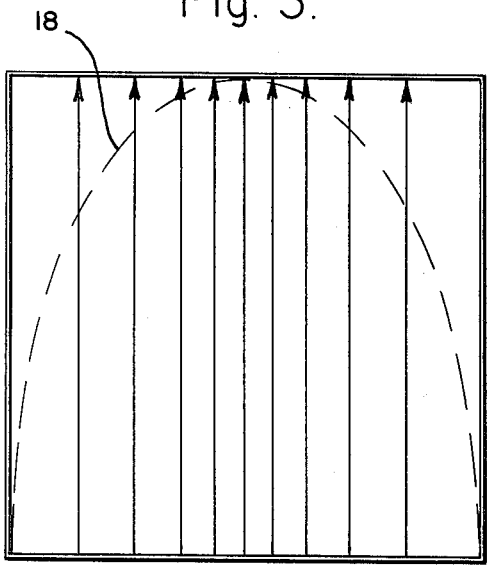
Fig. 4.
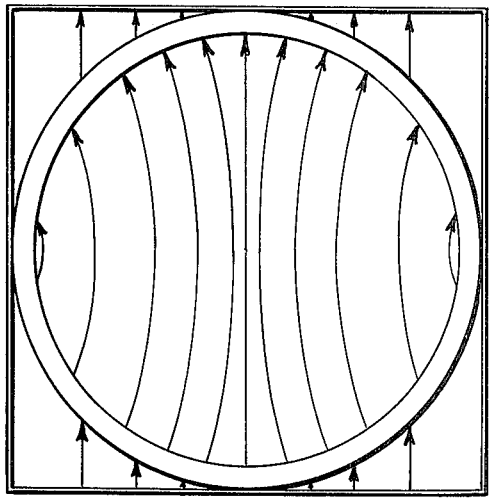

Relative Power (db)
2
4
6
8
10
12
14
16
18
21
20
-60°
0°
+60°
Angle off Axis

Relative Power (db)
10
12
14
16
18
20
22
24
26
28
23
-60°
0°
+60°
Angle off Axis Relative Power (db)
6
8
10
12
14
16
18
20
-60°
0°
+60°
Angle off Axis
26
25

12
14
16
18
20
22
-60°
0°
+60°
Angle off Axis
28

SQUARE HORN ANTENNA HAVING IMPROVED ELLIPTICITY

BACKGROUND OF THE INVENTION

1. Field of the Invention

The invention relates generally to antennas and in particular relates to multisided horn antennas.

2. Prior Art

Horn antennas for transmitting and receiving microwave energy are generally known in the prior art. In numerous satellite applications, horn antennas with square apertures are usually used for a variety of reasons including, for example, to provide a closely packed array of horns with greater efficiency. Additionally, a square horn antenna has an aperture with greater area than a conical horn antenna of the same diameter. Therefore, greater power may be radiated from a given area of an antenna array. There are, however, several drawbacks associated with square horn antennas, the principal drawback being that the axial ratio or ellipticity is inferior to that of a conical antenna or similar aperture shape. The engineering "trade-off" of a square horn antenna is its capability of transmitting greater power at the sacrifice of ellipticity. The ellipticity of small square horn antennas has not, prior to the present invention, been substantially improved upon without a significant sacrifice in efficiency. One of the techniques has been to insert a dielectric ring or sleeve in the throat of the horn. Such a dielectric ring must be accurately placed so that the impedance between the ring loaded launcher and the flared section of the horn is matched.

Another method of improving the ellipticity of a square horn antenna is with the use of corrugations within the horn. These corrugations excite the higher order modes and thereby improve ellipticity. The corrugation technique requires relatively large apertures thereby requiring a relatively large horn and the attendant increase in weight. Such an increase in weight has the distinct disadvantage in satellite applications. Also, the corrugated horn is usually machined from a solid metal stock and the corrugations must be precisely machined. Consequently, cost of machining a corrugated horn is high.

Fins have also been employed in order to equalize E and H fields, and thereby improve ellipticity at the aperture of horn antennas. Usually two sets of fins are placed in diametric opposition providing E and H symmetry to the signal from the horn. The size, number and locations of the fins are critical for providing phase compensation to the two fields. Using fins, however, provides poor isolation between orthogonal waves such as right and left-hand circularly polarized waves being propagated within a square horn antenna.

SUMMARY OF THE INVENTION

Accordingly, it is an object of the invention to provide a simple, lightweight and broadband antenna structure.

It is another object of the present invention to provide a square horn antenna having improved ellipticity.

It is still another object of the present invention to provide a square horn antenna having a signal with equalized E and H fields.

In accordance with the above objects, a multisided horn antenna includes a conical section disposed within the aperture of the horn. The conical section has a predetermined length, and diameter for improving the axial ratio and equalizing the E and H fields of a wave propagating therethrough.

BRIEF DESCRIPTION OF THE DRAWINGS

FIG. 1 is a perspective view of the drawing of a square horn antenna with a conical ring at the aperture.

FIG. 2 is a cross-sectional view illustrating the conical ring of FIG. 1.

FIG. 3 is a vector diagram of the E field distribution of a square horn antenna according to the prior art.

FIG. 4 is a vector diagram of the E field distribution of a square horn antenna according to the present invention.

Figure 5:
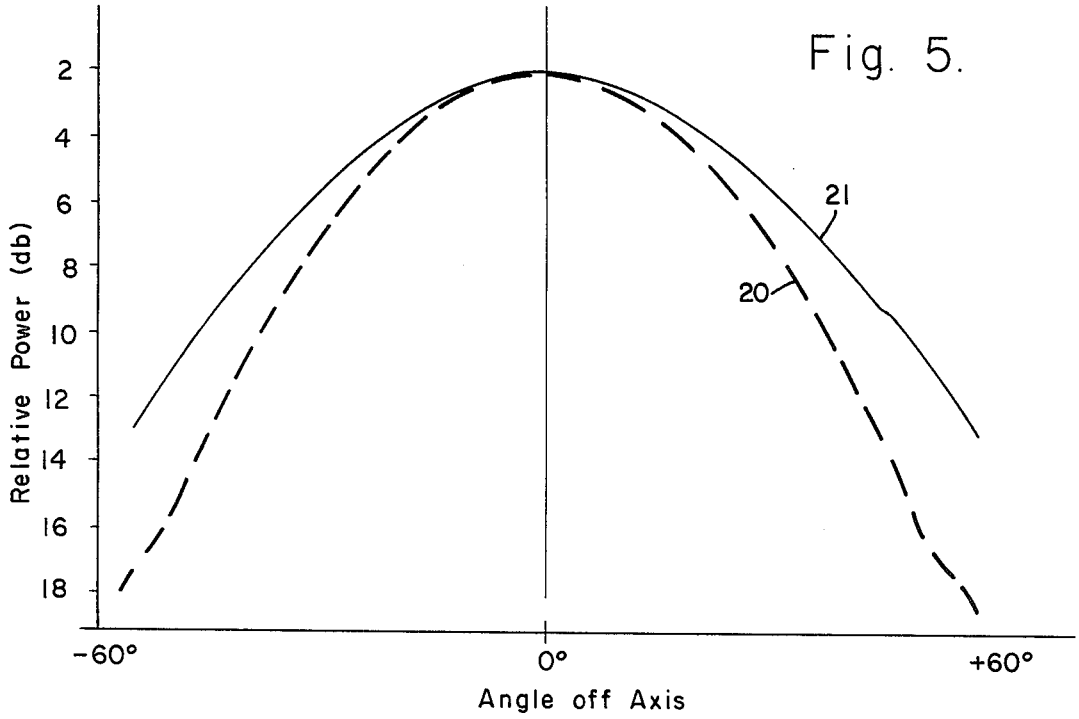
FIG. 5 is a waveform diagram illustrating the E and H fields of a square horn antenna according to the prior art.

Referring more specificially to FIG. 1, an antenna 10 according to the present invention is now described. The antenna 10 includes a square horn 11 with a conical ring or section 12 mounted at the aperture 13 of the horn 11. The antenna 10 has a rectangular input port 14 for receiving linear or circularly polarized waves from a transmitter (not shown). A transformer or launcher section 15 which consists of a series of steps connects the input port 14 with the horn 11. Alternately, the input port 14 may be square thus obviating the need of a transformer section 15. The horn 11 has a square cross-section and has a predetermined flare angle such as 14 degrees between opposite sides. The horn 11 may be made of a metallized fiberglass or out of aluminum or some other lightweight material for use in space.

The conical ring section 12 is mounted at the aperture 13 of the horn 11. The ring is made of a thin conductive material such as aluminum which is of sufficient thickness to withstand mechanical vibrations and thin enough to provide the required improvement in ellipticity. The major diameter of the ring 12 is approximately equal to the length of one side of the square aperture 13. The minor diameter of the ring 12 is slightly less than the length of a side one-quarter wavelength from the aperture of the horn 11. The flare or taper of the conical ring 12 may be slightly greater than the flare angle of the horn 11 so that the minimum diameter of the ring does not "short" the propagating wave. The major diameter ring 12 may be attached to the aperture of the horn 11 by brazing, soldering or other convenient methods. A more detailed description of the conical ring may be found below.

Referring now to FIG. 2, the conical ring 12 is now described with respect to that figure. A ring 12 was constructed for a horn antenna transmitting in the 3.7 to 4.2 GHz band. The ring 12 has a flare angle of approximately 16° and is approximately one-quarter wavelength long. The quarter wavelength refers to the center frequency of the band. It was found that a thickness of 0.005 inches would sufficiently improve the axial ratio or ellipticity without affecting the gain of the antenna 10 to a substantial degree. At some frequencies, it was found that a ring thickness of approximately 0.020 inches improved the ellipticity much greater than the 0.005 ring. As mentioned above, the major diameter of the ring 12 may be attached to the aperture region 13 by brazing. The minor diameter may be separated from the body of the horn 11 by dielectric wedge-shaped members 16 spaced about the outside of the conical ring 12. The wedges 16 may be cemented in place by the proper glue. The wedges 16 are for separating the minor edge of the ring 12 from the horn 11.

Referring now to FIG. 3, the graph illustrates the E vector field of a vertically oriented linear signal at the aperture of a typical prior art square horn antenna. From the diagram, it is apparent that the greatest E field density is at the mid section of the aperture and as the energy approaches the side walls of the horn the density diminishes and the E vector or voltage becomes zero. This results from the fact that the sides of the aperture present a short circuit to the propagating wave, causing a high RF current to flow along the sides and thereby reducing the voltage to zero. The dashed line 18, in the shape of a hyperbola, represents the resultant E field density within the square aperture horn. As will be seen more clearly below, the ellipticity of a square aperture horn is of lower quality because of the geometry of a square. As a square horn is rotated on its axis, the amount of energy it can admit or transmit varies. For example, when an E vector is perpendicular to opposite sides of a unit square, the length of the vector is one unit. When, however, the square is rotated 45°, the length of the vector that can be received or transmitted is now 1.41 units long. Thus, the ellipticity varies accordingly.

In FIG. 4, the E vector field of a vertically oriented linear signal propagating in a square horn 10 having a conical ring 12, according to the present invention, is illustrated. It may be seen in FIG. 4 that the E vector density decreases as the E vector is further removed from the center section of the circular aperture. The conical ring 12, because of its small thickness, is partially transparent to the propagating wave. Thus, the corners of the square aperture are also excited, albeit only partially. Since the geometry of a rotating square horn 10 is improved by the use of the conical ring 12, the E vector varies very little because of the apparent circular aperture 13. The improved ellipticity is more clearly demonstrated below.

Referring now to FIG. 5, the dashed curve 20 illustrates the E vector field of a 3.9 GHz linear signal at the aperture of a square horn that is 3.00 inches on a side. The abscissa represents the off-axis angle of the receiving antenna to the transmitting antenna. The ordinate axis represent relative power in dB. The solid curve 21 illustrates the H vector field of the same linear signal. Both the curves 20 and 21 trace the performance of a receiving antenna which is offset from the transmitting antenna by 60° on either side of the axis of the transmitting antenna. From the graph, it is apparent that the E and H fields diverge as the "off-axis angle" increases. The divergence of these two curves is indicative of the axial ratio or ellipticity of a circularly polarized signal being received by the antenna as will be shown below. One of the features of the invention is to cause the E and H fields of the signal in the square horn to converge as the off-axis angle increases.

Figure 6:
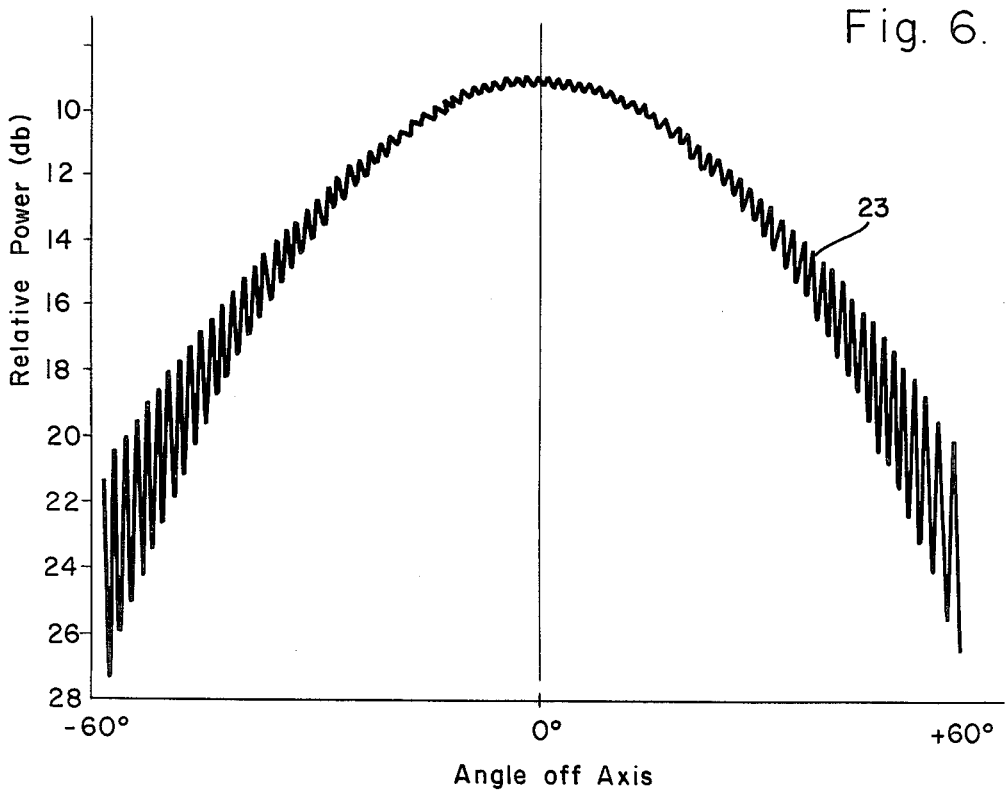
FIG. 6 is a waveform diagram illustrating the ellipticity curve of a square horn antenna according to the prior art.

The curve 23 of FIG. 6 illustrates the ellipticity of a 3.9 GHz circularly polarized signal within a 3-inch square horn. The abscissa of the graph corresponds to the off-axis angle of a receiving antenna to an antenna transmitting signals. The coordinate axis corresponds to the relative power difference measured in dB. It may be seen from the graph that as the off axis angle increases, the ellipticity also increases from a zero angle value of approximately 0.2 dB to a maximum relative value at 60° of approximately 8 dB. One of the objects of the present invention is to decrease the ellipticity as the off axis angle increases.

Figure 7:
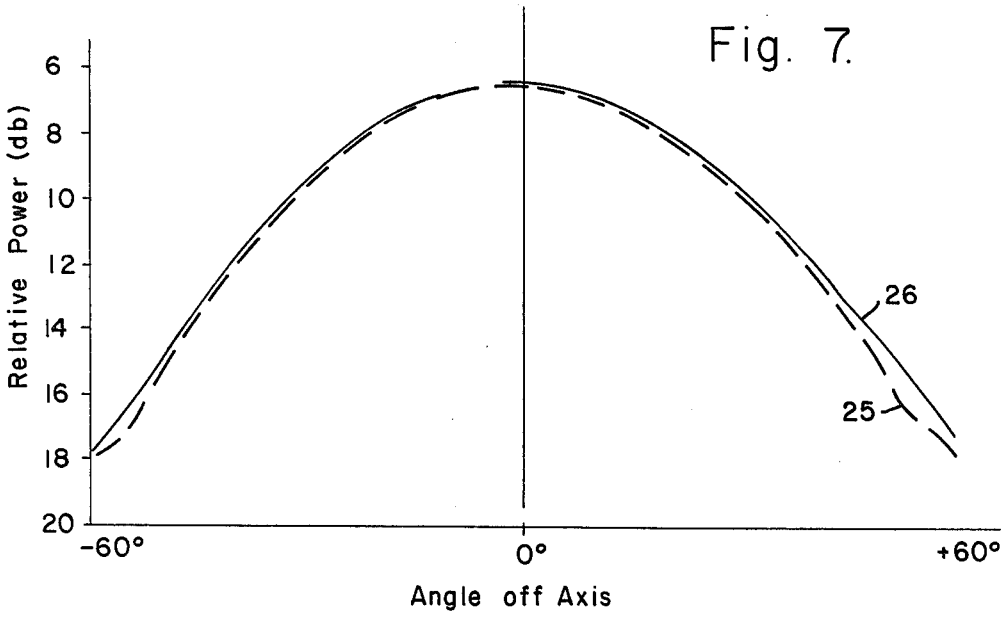
FIG. 7 is a waveform diagram illustrating E and H fields of a square horn antenna according to the present invention.

Referring now to FIG. 7, the dashed curve 25 illustrates the E vector field of a 3.9 GHz linear signal received by a 3.00 inch square horn antenna according to the present invention. The solid curve 26 illustrates the H vector field being received by the same antenna. It is seen that the E and H vectors are practically coincident throughout the entire range of +60° to −60°. From the graph it is apparent that the maximum variation in relative power between the E and H curves is approximately 0.8 dB at +54°. Thus, the invention has improved upon the maximum variation of 5 dB of a horn without the invention.

Figure 8:
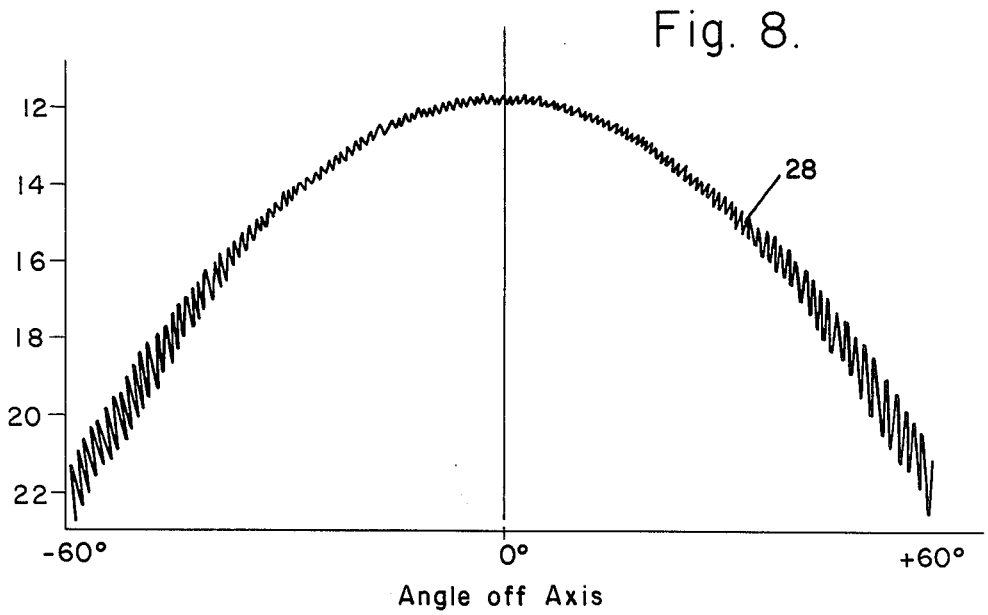
FIG. 8 is a waveform diagram illustrating the ellipticity curve of a square horn antenna according to the present invention.

Referring now to FIG. 8, the curve 28 illustrates the ellipticity of a 3.9 GHz circularly polarized signal being received by a horn according to the present invention. Again, it is apparent that the ellipticity has been greatly improved throughout the entire range from + to −60 off-angle degrees. The maximum variation in relative power of the ellipticity curve is approximately 2.3 dB as compared to the maximum of a prior art antenna of 6.3 dB.

In summary, the present invention includes a square or other multisided horn structure having a quarter wavelong conical ring disposed at the aperture. The conical ring improves the E and H field vectors of a linear signal being received or transmitted between antenna as well as the ellipticity.

Although the present invention has been shown and described with reference to a particular embodiment, nevertheless various changes and modifications obvious to one skilled in the art to which the invention pertains are deemed within the purview of the invention.

What is claimed is:

1. A horn antenna having improved ellipticity, comprising:

an N-sided horn antenna having a predetermined angle of flare, N being at least four, said horn having an input port and an aperture, said horn having a predetermined length; and a right circular truncated hollow conical section being mounted tangentially to the inside of said N-sided horn antenna at the aperture thereof, said conical section having a predetermined relatively short length and being of an electrically conductive material having a thickness of less than 0.1 wavelength and being attached to each side of said N-sided horn antenna so that a wave propagating through said conical section is not attenuated, said conical section being for improving the ellipticity of a wave passing therethrough.

2. The invention according to claim 1, wherein said right circular truncated hollow conical section comprises:

a conical section being one-quarter wavelength in length and having an angle of flare greater than the angle of flare of said N-sided horn antenna.

3. The invention according to claim 1, wherein said N-sided horn antenna has four sides and a square cross-section.

4. A horn antenna having improved ellipticity, comprising:

an N-sided horn antenna having a predetermined angle of flare, N being at least four, said horn antenna having a stepped transformer input port and an aperture port; and a ring member having a major diameter and a minor diameter, said ring member being mounted to the inside of said N-sided horn antenna at the aperture along said major diameter, said minor diameter being disposed so that said minor diameter does not contact said horn antenna, said ring member having a length of one-quarter wavelength and being of a conductive material having a thickness less than 0.1 wavelength.

* * * * *